US008990967B2

(12) United States Patent
Tallon

(10) Patent No.: US 8,990,967 B2
(45) Date of Patent: Mar. 31, 2015

(54) PORTABLE COLLAPSIBLE CHANGING STATION

(71) Applicant: Christopher Tallon, Hawthorne, CA (US)

(72) Inventor: Christopher Tallon, Hawthorne, CA (US)

( * ) Notice: Subject to any disclaimer, the term of this patent is extended or adjusted under 35 U.S.C. 154(b) by 86 days.

(21) Appl. No.: 13/761,023

(22) Filed: Feb. 6, 2013

(65) Prior Publication Data

US 2014/0216512 A1 Aug. 7, 2014

(51) Int. Cl.

| | |
|---|---|
| ***E04H 15/30*** | (2006.01) |
| ***A45F 4/12*** | (2006.01) |
| ***A45C 3/00*** | (2006.01) |
| ***A45C 13/10*** | (2006.01) |
| ***A45F 3/02*** | (2006.01) |
| ***E04H 15/00*** | (2006.01) |
| *E04H 1/12* | (2006.01) |

(52) U.S. Cl.

CPC *E04H 15/30* (2013.01); *A45F 4/12* (2013.01); *A45C 3/001* (2013.01); *A45C 13/103* (2013.01); *A45F 3/02* (2013.01); *E04H 1/1266* (2013.01); *E04H 15/003* (2013.01)

USPC ..... 2/89

(58) Field of Classification Search

USPC ..... 2/69, 69.5, 84, 89

See application file for complete search history.

(56) References Cited

U.S. PATENT DOCUMENTS

| | | | | | |
|---|---|---|---|---|---|
| 582,639 | A | * | 5/1897 | Gray | 4/536 |
| 601,891 | A | * | 4/1898 | Irwin | 4/524 |
| 1,466,166 | A | * | 8/1923 | Hodgson | 2/89 |
| 1,599,798 | A | * | 9/1926 | Stockton | 2/89 |
| 2,372,110 | A | | 3/1945 | Noone | |
| 2,376,284 | A | * | 5/1945 | Sidelmann | 2/89 |
| 3,079,611 | A | * | 3/1963 | Boryszewski | 2/89 |
| 3,132,344 | A | * | 5/1964 | Langdon | 2/1 |
| 3,228,034 | A | * | 1/1966 | Grove | 5/413 R |
| 3,288,157 | A | | 11/1966 | Szkolng | |
| 3,597,764 | A | * | 8/1971 | Povey | 2/69.5 |
| 3,610,251 | A | * | 10/1971 | Sanderson | 607/107 |
| 3,837,006 | A | * | 9/1974 | Laseman | 2/89 |
| 3,849,803 | A | * | 11/1974 | Connors | 2/84 |
| 4,035,606 | A | * | 7/1977 | Browder | 219/211 |
| 4,142,254 | A | | 3/1979 | Arnold | |
| 4,979,242 | A | | 12/1990 | Maggio | |
| 5,101,513 | A | | 4/1992 | Bowers | |
| 5,343,887 | A | | 9/1994 | Danaher | |
| 5,385,164 | A | | 1/1995 | Sauter | |
| 5,628,066 | A | * | 5/1997 | Gottlieb et al. | 2/84 |
| 5,875,492 | A | | 3/1999 | Moss | |
| 6,018,819 | A | * | 2/2000 | King et al. | 2/69 |
| 6,488,188 | B2 | | 12/2002 | Fleischli | |
| 6,840,254 | B1 | | 1/2005 | Windham | |

(Continued)

*Primary Examiner* — Shaun R Hurley

(74) *Attorney, Agent, or Firm* — Edwin P. Tarver, Esq.; Lauson & Tarver LLP

(57) ABSTRACT

A collapsible interactive personal privacy shelter for changing into and out of clothing and wet suits may be used in association with cold water activities, which is portable and convenient for use in both cold and warm climates. The preferred embodiment is of non see through, water resistant, translucent textile, partially insulated, trapezoidal in shape, having a triangular shaped flexible rubber pedestal and foam rubber changing matt. The textile is open at the top with a draw cord insulated hood, and forms an enclosure resting upon a user's shoulders, and is entered through a zippered opening running vertically down the front. Openings on either side of the enclosure are covered by wind flaps open on one side secured by hook and loop fastener.

13 Claims, 8 Drawing Sheets

(56) References Cited

U.S. PATENT DOCUMENTS

| | | | | |
|---|---|---|---|---|
| 7,036,153 | B2 * | 5/2006 | Gibson et al. | 2/69 |
| D541,011 | S | 4/2007 | Day | |
| 7,810,170 | B1 | 10/2010 | Guthrie | |
| 7,849,866 | B1 | 12/2010 | Mangum | |
| 8,042,195 | B1 * | 10/2011 | Massey | 2/69.5 |
| D677,859 | S * | 3/2013 | Andes | D2/825 |
| 8,533,865 | B2 * | 9/2013 | Tallon | 2/82 |
| 2012/0298161 | A1 * | 11/2012 | Tallon | 135/115 |

* cited by examiner

PORTABLE COLLAPSIBLE CHANGING STATION

BACKGROUND

The present invention is related in general to collapsible cubicle devices for providing privacy when changing clothes outdoors and in public. The invention lies in the field of portable enclosures for changing clothes and is directed to a device which may be opened and closed quickly for storage and transportation. It is more particularly directed to portable changing tent which may be opened and closed very quickly with no need for special skills or manual dexterity and which is sufficiently rigid for general use at beaches and other public places.

Many of the portable changing enclosures currently in the art are designed for changing in public in warm weather, are open on the bottom, and have a plurality of members which must be secured together with many fasteners requiring more time and dexterity to assemble. The use of neoprene rubber suits to sustain normal body temperature while submerged in cold water during water activities in cooler climates or during winter months is common, yet, there is no device that traps and recycles body heat released when a wetsuit is removed to protect a user from air and wind chill in low temperatures, or to provide a comfortable and safe surface upon which to stand while changing into and out of a wetsuit.

SUMMARY

The principal object of the invention is to provide a safe and comfortable surface and enclosure in which to change into and out of a wetsuit while preventing damage and soiling of sports gear, and that conveniently collapses into a carrying bag when zipped closed.

Another objective of the present invention is to provide a temporary, wearable, and collapsible privacy shelter that provides thermal, wind, and rain protection in cold climates while changing in public.

Still another objective of the present invention is to provide a waterproof pocket inside of a pedestal to separate dry clothing from wet gear.

Still another objective of the present invention is to make a temporary wearable privacy shelter which is detachable so that a pedestal portion may be used independently.

It is also an objective of the present invention to provide an enclosure that accommodates the physical movements required by a user to disrobe from a wetsuit.

In addition to the forgoing general description of the invention, another important objective of the invention is to create a range of sizes, each size large enough to allow a user to change freely and safely.

The forgoing objectives can be accomplished by providing a device that combines a triangular shaped pedestal consisting a durable rubber bottom, a side panel consisting of a thin structural material adding support sandwiched between a waterproof interior panel and a durable exterior fabric, and a triangular shaped waterproof fabric pocket separating wet and dry gear.

A waterproof abrasion resistant foam pad resting upon a pedestal adds comfort and protects gear, while a zipper along a top interior pedestal wall zips to a partially insulated enclosure that rests upon a users shoulders and conveniently collapses into a pedestal. A second zipper along the top exterior pedestal wall transforms the pedestal into a carrying bag when zipped closed, a shoulder belt fixed to one end of a carrying bag and attachable and detachable at a opposite end through a slider buckle.

One preferred embodiment is of non see-through, water resistant, translucent textile, which may be insulated, trapezoidal in shape, open at the top, with a draw cord insulated hood. The changing station rests upon a user's shoulders and is entered through a covered zippered opening running vertically down a front upper insulated panel, openings on either side of the enclosure are covered by wind flaps open on one side secured by hook and loop fastener.

In an alternative embodiment, the portable and collapsible changing station includes a collapsible enclosure having an open top adapted to surround a user's neck, and an open bottom having a circumference larger than the open top. The enclosure includes an opaque upper section and a translucent lower section and has a base corresponding in circumference to the open bottom, wherein the base is removably attachable to the lower section and folds to form a releasably sealable pocket structure adapted to contain the enclosure.

To provide a separation between wet sports gear and dry clothing, a lid is hingedly attached to the base and is adapted to cover the base, independent of the attachment between the open bottom and the base, and may be detachable. Preferably the lid has a closeable opening on both surfaces, allowing access to contents held behind the lid, and also includes a connector, allowing a user to releasably attach to a connector on the upper section, thereby forming a pocket which allows a user to reach clothing in the pocket.

The base may include a vertical wall extending upward from a pedestal for stability, and preferably includes a shoulder strap which extends from the base at one end. Preferably the shoulder strap is designed to releasably connect to the base at the other end, forming a wearable loop when the base is folded up, containing the enclosure and sports gear in an envelope-like carrying bag.

In a preferred embodiment, the enclosure includes arm openings on opposite sides of the upper section, allowing a user access to the exterior of the enclosure when worn. Sealable flaps may cover the arm openings when not in use. In addition to the arm openings, a slot extending downward from the open top, preferably including a fastening means such as a zipper, allows a user to open the enclosure, step into the base, and raise the enclosure around the user's body.

For cold climates, a hood may be included, adapted to engage the open top. Preferably the hood includes a draw cord, and may include a wind flap incorporated into a slot extending downward from the open top, to help seal the slot in windy conditions.

Another embodiment contemplates omitting the enclosing privacy screen altogether. In this embodiment, the privacy screen may be removed from the pedestal by a user, or omitted during manufacturing. In this embodiment, it is anticipated the pedestal or base will have a side wall and an open top, with the open top adapted to close along the top to form a carrying bag. In this embodiment, a single zipper or other attachment for closing the open top would be disposed along the top.

REFERENCE NUMBERS IN THE FIGURES

Figure 1:
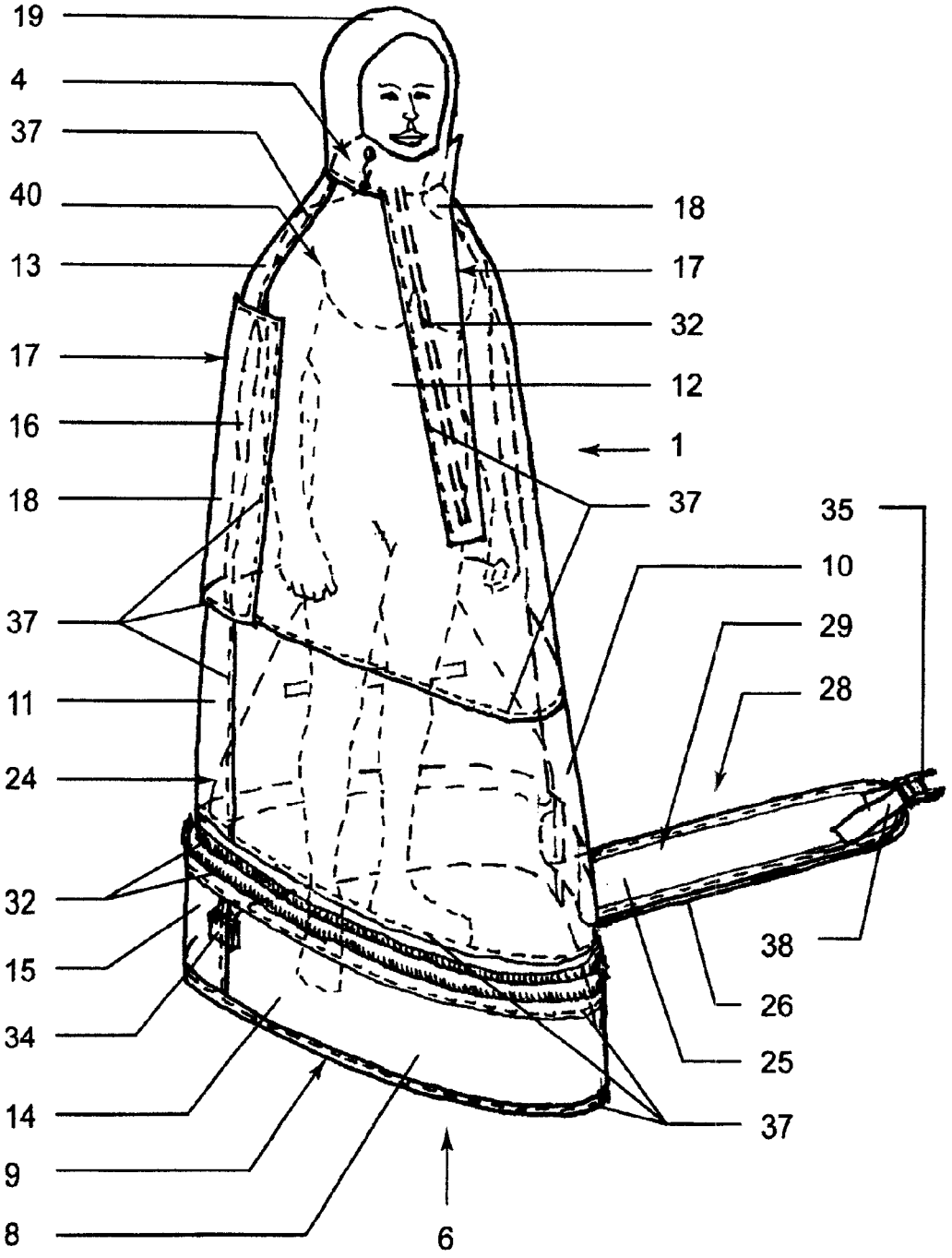
FIG. 1 illustrates an axonometric projection of an enclosure attached to a closed base according to an embodiment of the invention.

1. an enclosure
2. a front wall
3. a rear wall
4. an open top
5. an open bottom
6. a closed base
7. a pedestal or base
8. a pedestal wall
9. a flexible rubber pedestal base
10. a lower front translucent panel of a translucent lower section
11. a lower rear translucent panel of a translucent lower section
12. an upper front insulated panel of an opaque upper section
13. an upper rear insulated panel of an opaque upper section
14. a front panel of a vertical wall
15. a rear panel of a vertical wall
16. an arm opening in panel seam
17. open side of a wind flap
18. a wind flap
19. a draw cord insulated hood
20. a foam rubber matt
21. a durable exterior textile
22. a waterproof interior textile
23. a stiffening material
24. a resealable pocket structure
25. a top panel
26. a bottom panel
27. apex of a pocket
28. a shoulder belt or strap
29. a rubber material
30. a textured bottom
31. insulation
32. a zipper
33. a hook and loop fastener
34. a slider buckle
35. a slider clip
36. an envelope-like carrying bag
37. sewn stitch
38. structural textile
39. an interactive base
40. a user
41. a user's foot
42. physical positions required in the art of changing out of a wetsuit.
  a. user balancing on leg inside embodiment of invention.
  b. user inside embodiment of invention kicking opposite leg to release gear from lower leg.
  c. user inside embodiment of invention releasing arms for safety and to exchange gear.
  d. user kneeling safely inside pedestal upon foam rubber matt removing gear from foot.

DESCRIPTION

The following detailed description represents the best currently contemplated modes of carrying out the invention. The description is not to be taken in a limiting sense, but is made merely for the purpose of illustrating the general principals of the invention.

Figure 2:
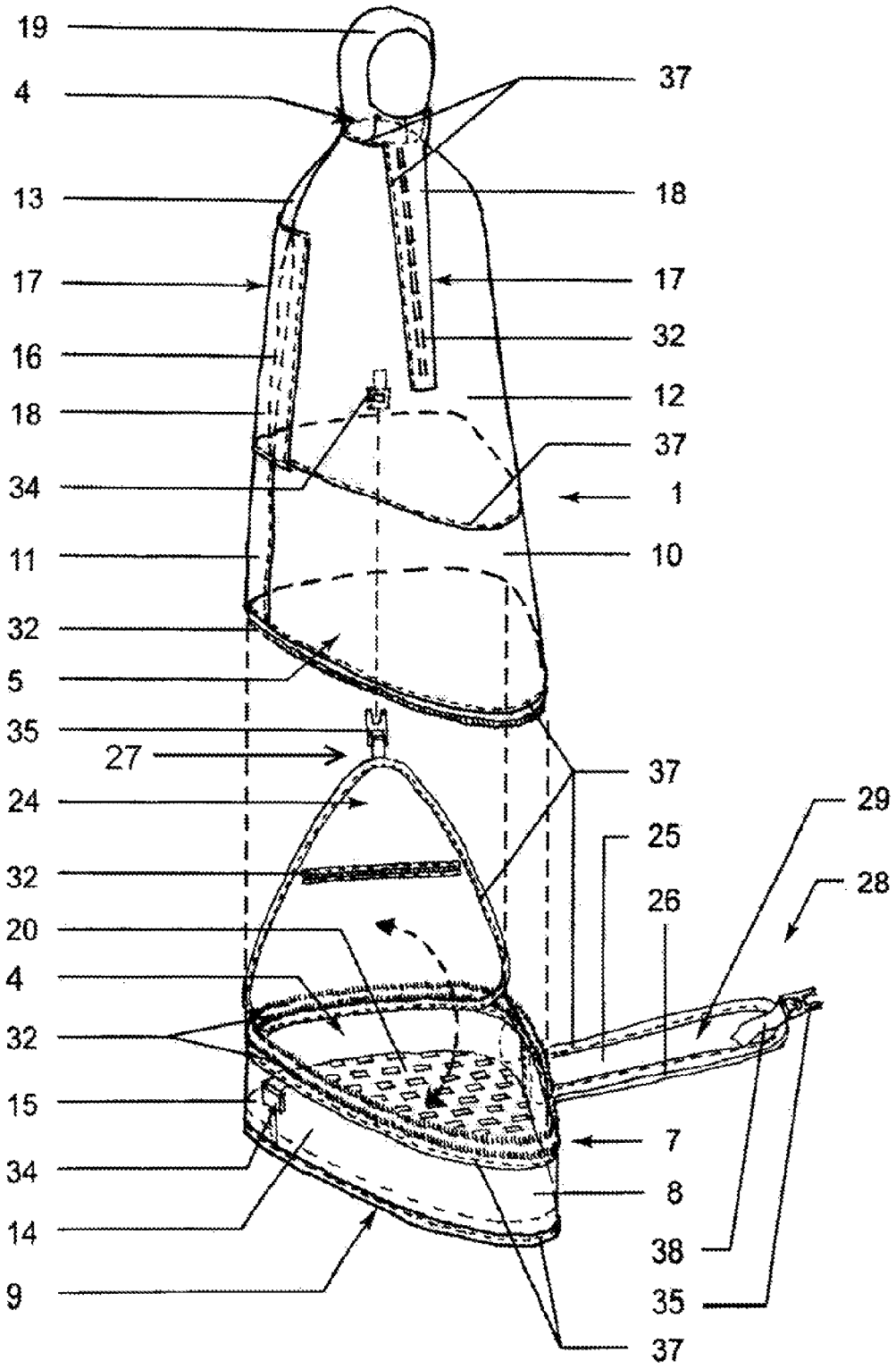
FIG. 2 illustrates an exploded axonometric projection of an enclosure detached from a pedestal base according to an embodiment of the invention.
Figure 3:
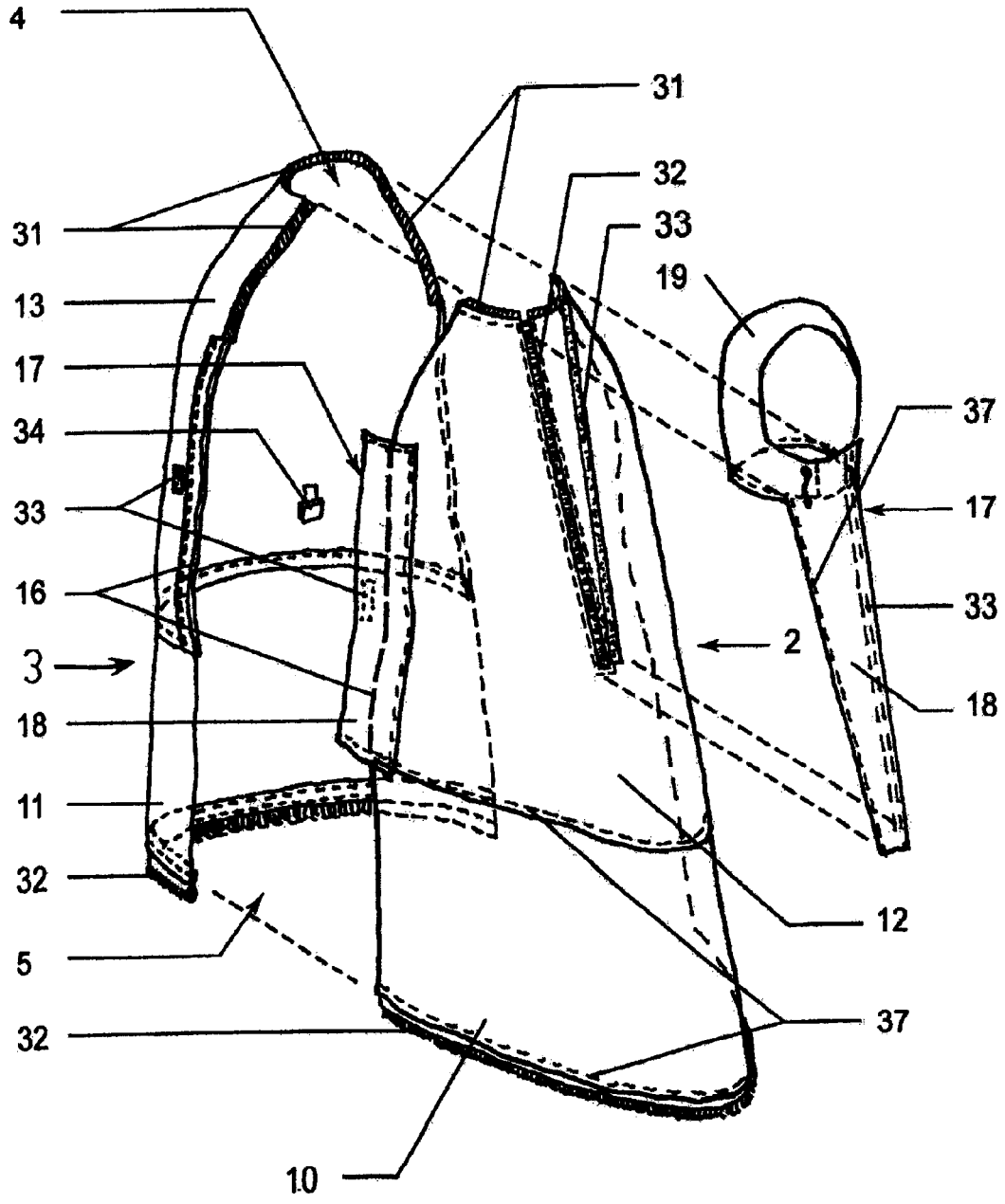
FIG. 3 illustrates a partial exploded axonometric projection of an enclosure and in its functional condition.
Figure 4:
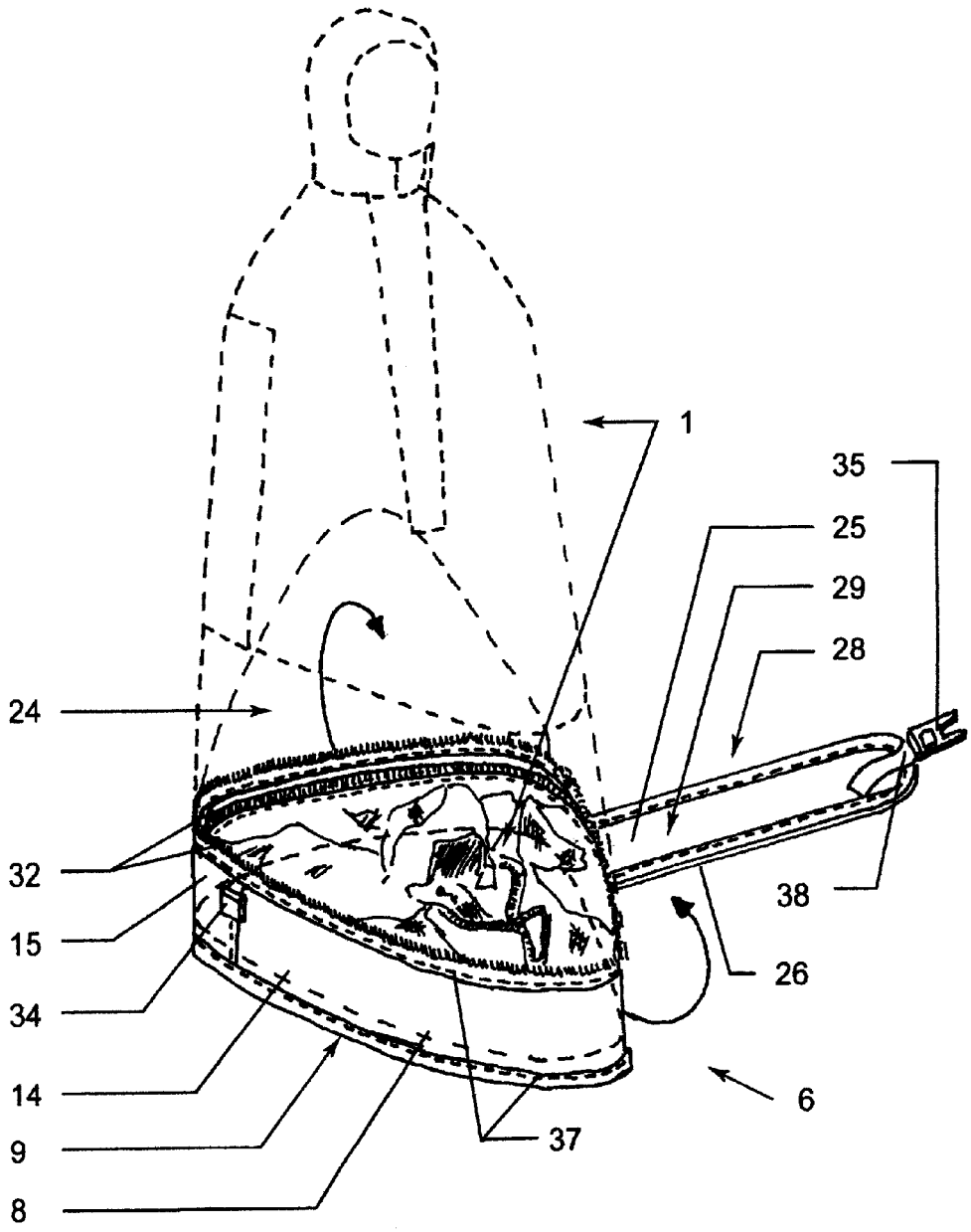
FIG. 4 illustrates an axonometric projection of a collapsible enclosure according to an embodiment of the invention.

Referring to FIGS. 1, 2 and 3, an enclosure 1 that may be portable and collapsible as shown in FIG. 4, may be of generally trapezoidal form having a front wall 2, a rear wall 3, an open top 4 with an attached draw cord insulated hood 19, and a closed base 6. A front wall 2 may be made of lightweight, non see through, water resistant textile cut into two panels; an upper front insulated panel 12 with a zippered opening 32, which may be sewn 37 to a lower front translucent panel 10, which may be sewn 37 to a rear wall 3, which may be made of lightweight, non see through, water resistant textile cut into two panels; an upper rear insulated panel 13 which may be sewn 37 to a lower rear translucent panel 11.

There may be an opening 16 between an upper front insulated panel 12, and an upper rear insulated panel 13 as shown in FIGS. 1, 2 and 3, over which may be a wind flap 18 which may be sewn 37 to an upper front insulated panel 12 on three sides and which may be open down a side 17 at rear of an enclosure 1 which may be closed by a hook and loop fastener 33.

As shown in FIGS. 1, 2 and 3, there may be a zipper 32, which may be sewn 37 to an upper front insulated panel 12, which may be entered through a top opening 5, which may be opened and closed from both inside and outside of an enclosure 1.

As shown in FIGS. 1, 2 and 3, there may be a draw cord insulated hood 19 which may be sewn 37 to an open top 4. Extending down from one side of a draw cord insulated hood 19 may be a wind flap 18 which may be sewn 37 to an upper front insulated panel 12 adjacent a zipper 32, which may be opened and closed by a hook and loop fastener 33, which may be sewn 37 adjacent open side of a wind flap 18.

As shown in FIGS. 1, 2 and 3, there may be one half a one way separating zipper 32, which may be sewn 37 inside along an open bottom 5 of an enclosure 1 which may be attached and detached from inside and outside of an enclosure 1, to a remaining half of a one way separating zipper 32, which may be sewn 37 inside along an open top 4 of a pedestal 7 as shown in FIGS. 1, 2, 4, 6 and 7.

Figure 5:
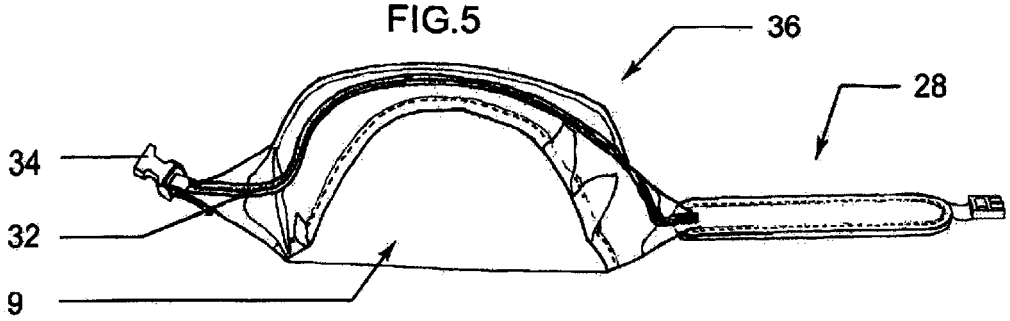
FIG. 5 illustrates an axonometric projection of a pedestal base transformed into a carrying bag according to an embodiment of the invention.
Figure 6:
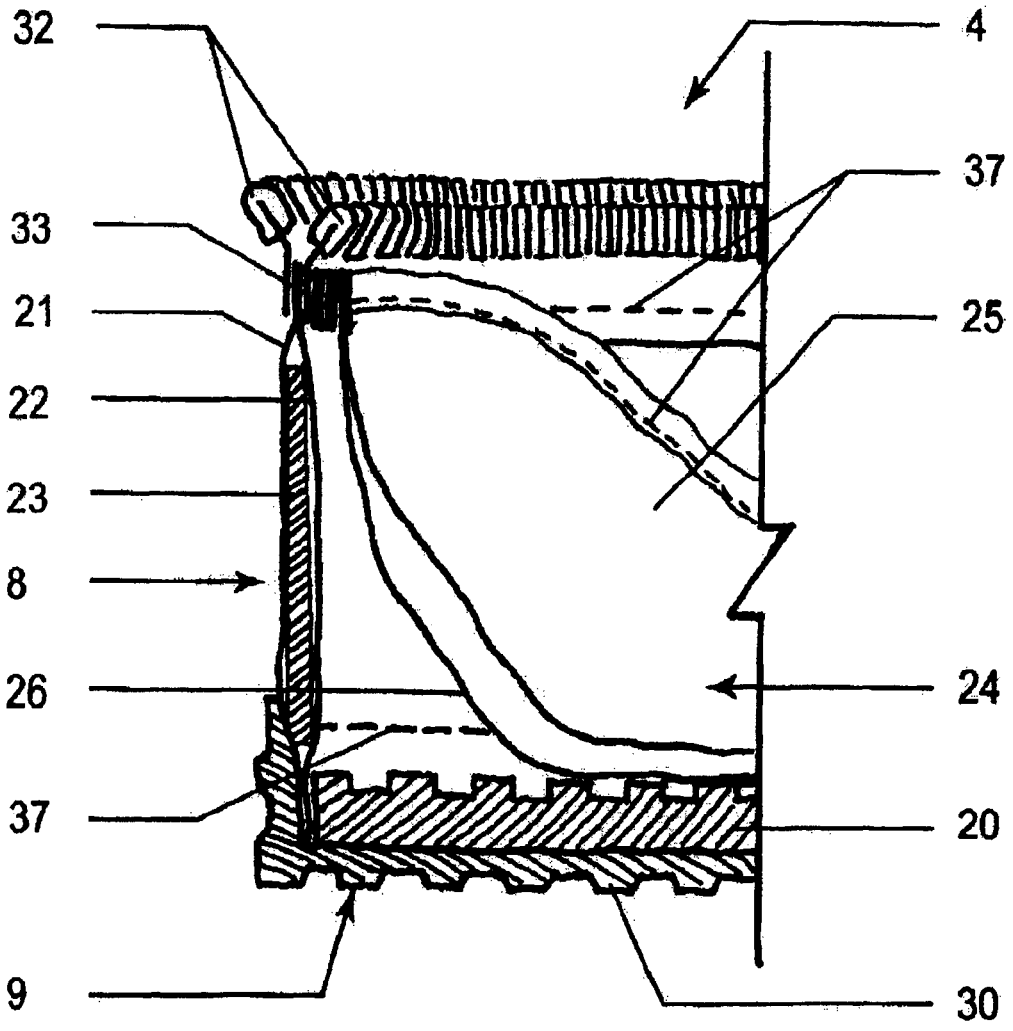
FIG. 6 illustrates a section detail of a pedestal base according to an embodiment of the invention.

In FIGS. 1, 2, 4, 6 and 8, there may be a pedestal 7, which may consist of a top opening 4, a wall 8 cut into two panels; a front panel 14 and a rear panel 15, which may be comprised of a durable exterior textile 21 and a durable waterproof interior textile 22 between which may be a stiffening material 23 which may be sewn 37 to a flexible rubber pedestal base 9, having a textured bottom 30 upon which may be a waterproof, abrasion resistant, foam rubber matt 20. As shown in FIGS. 4 and 5, there may be a zipper 32, which may be sewn 37 outside along an open top 4 that when zipped closed may transform a pedestal 7 into a carrying bag 36.

In FIGS. 1, 2, 4, 6 and 8 there may be a triangular shaped pocket 24, which may consist of two light weight, waterproof, textile panels; a top panel 25, and a bottom panel 26 which may be sewn 37 along outside edge, which may incorporate a zipper 32 which may be sewn 37 along a top panel 25 and a bottom panel 26, which may consist of a slider buckle 34 sewn 37 to apex of the triangular shaped pocket 24, which may be attached to a slider clip 35 sewn 37 inside an upper rear insulated panel 13, which may be attached inside an open top 4 of a rear panel wall 15 by hook and loop fastener 33.

In FIGS. 1, 2, 4 and 5, there may be a shoulder belt 28 which may be comprised of two durable rubber panels; a top panel 25 and a bottom panel 26, between which may be sewn 37 a structural textile 38 of which an end may be sewn 37 to a pedestal wall 8 and an opposite end which may consist of a slider buckle 34 attachable and detachable to a slider clip 35 which may be sewn 37 to a pedestal wall 8.

Figure 7:
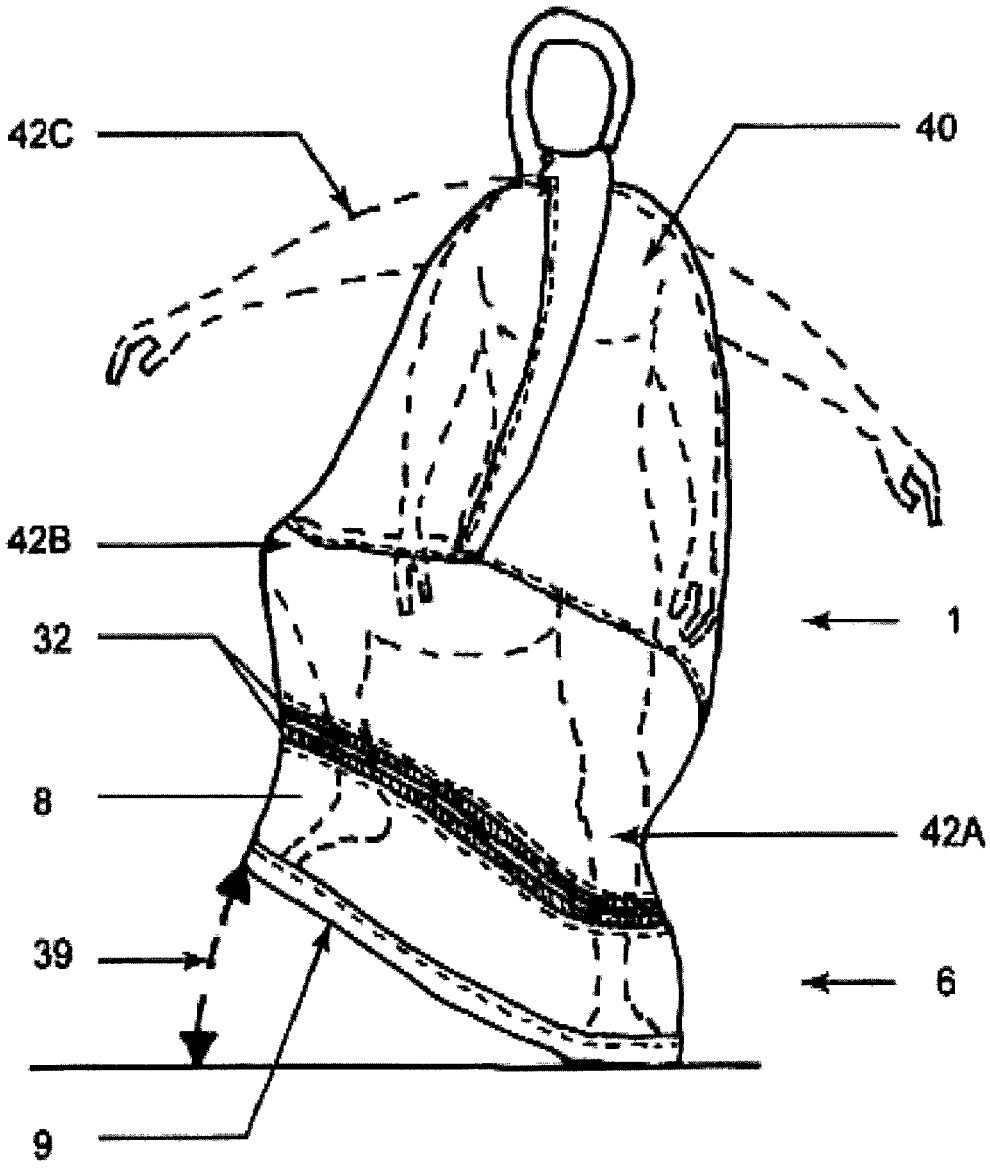
FIG. 7 illustrates the functional condition of an enclosure as it interacts with the physical movements of a user according to an embodiment of the invention.
Figure 8:
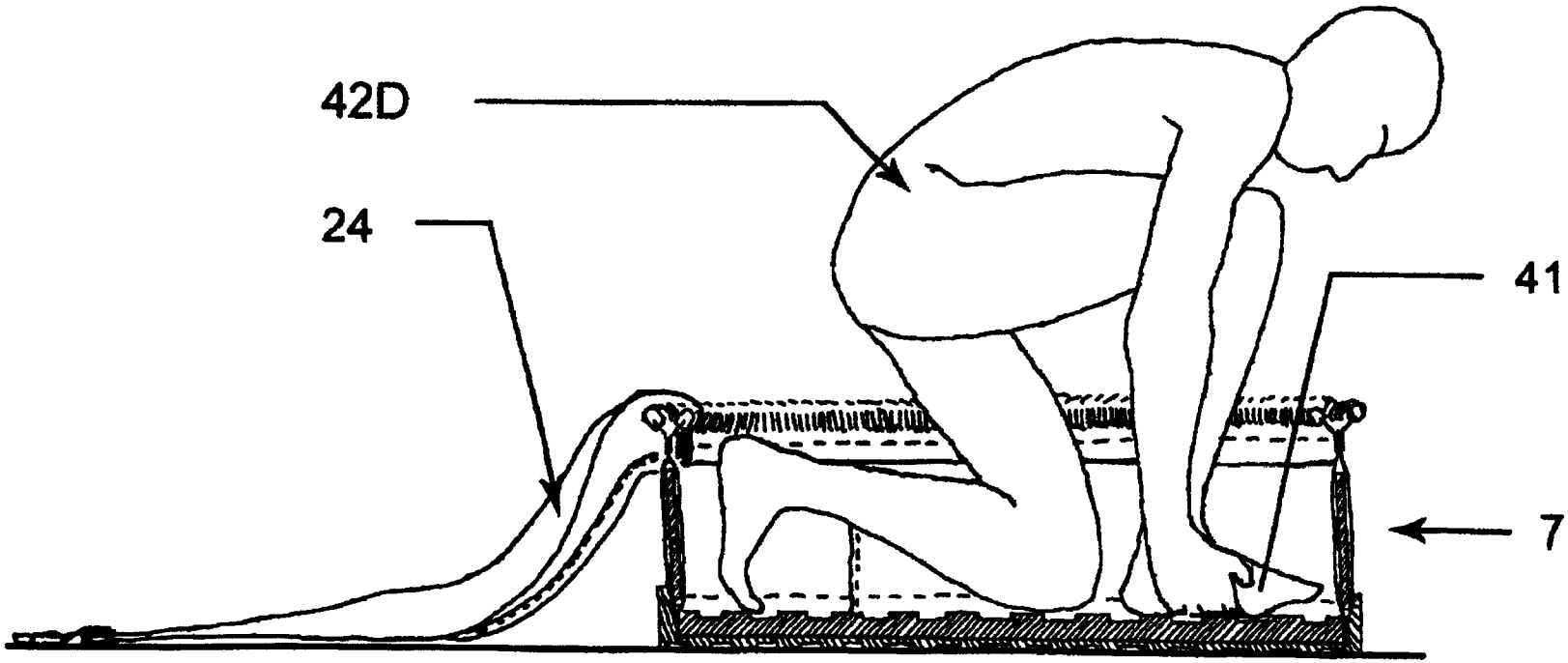
FIG. 8 illustrates the functional condition of a pedestal base according to an embodiment of the invention.

FIGS. 7 & 8 show embodiment of the invention interacting 39 with a users 40 physical movements 42*a*, 42*b*, 42*c*, & 42*d* required to disrobe.

FIG. 8 shows a user 40 kneeling safely upon a padded triangular shaped pedestal 7 allowing the best possible leverage to release gear from foot 41.

What is claimed is:

1. A portable and collapsible changing station comprising:

a collapsible enclosure having an open top adapted to surround a user's neck, and an open bottom having a circumference larger than the open top;

the enclosure having an opaque upper section and a translucent lower section; and a base corresponding in circumference to the open bottom, wherein the base is removably attachable to the lower section and wherein the base folds to form a releasably sealable pocket structure adapted to contain the enclosure.

2. The changing station of claim 1 further comprising a lid hingedly attached to the base, adapted to removably cover the base, independent of the attachment between the open bottom and the base.

3. The changing station of claim 2 wherein the lid further comprises a closeable opening on its surface.

4. The changing station of claim 2 wherein the lid further comprises a connector opposite the hinge, that releasably attaches to a connector on the upper section.

5. The changing station of claim 1 wherein the base further comprises a vertical wall extending upward from a platform.

6. The changing station of claim 1 wherein a shoulder strap extending from the base is adapted to releasably connect to the base, forming a wearable loop.

7. The changing station of claim 1 further comprising arm openings on opposite sides of the upper section.

8. The changing station of claim 7 further comprising releasably sealable flaps over the arm openings.

9. The changing station of claim 1 further comprising a resealable slot extending downward from the open top adapted to allow a user to raise the enclosure around the user's body.

10. The changing station of claim 1 further comprising a hood adapted to engage the open top.

11. The changing station of claim 10 wherein the hood includes a draw cord.

12. The changing station of claim 10 wherein the hood includes a wind flap incorporated into a slot extending downward from the open top.

13. A privacy shelter for a user to change clothing comprising:

a base comprising a pedestal and a side wall, and having an opening, the opening adapted to close to form a carrying bag for enclosing a collapsible enclosure when closed, and engaging a collapsible enclosure when open;

the collapsible enclosure having a hood connected to an opaque upper section and a translucent lower section, the collapsible enclosure sized to surround the user, the lower section having an opening adapted to engage the base; and a lid hingedly connected to the base and adapted to engage the collapsible enclosure, thereby creating a pocket inside the enclosure when worn.

* * * * *